US009331405B2

(12) United States Patent
Tsang et al.

(10) Patent No.: US 9,331,405 B2
(45) Date of Patent: May 3, 2016

(54) INTERFACE CONNECTOR

(71) Applicant: Tyco Electronics Corporation, Berwyn, PA (US)

(72) Inventors: Albert Tsang, Harrisburg, PA (US); Kevin Michael Thackston, York, PA (US); Keith Edwin Miller, Manheim, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/295,050

(22) Filed: Jun. 3, 2014

(65) Prior Publication Data

US 2015/0349459 A1 Dec. 3, 2015

(51) Int. Cl.

| | |
|---|---|
| ***H01R 13/627*** | (2006.01) |
| ***H01R 12/70*** | (2011.01) |
| ***H01R 13/46*** | (2006.01) |
| ***H01R 13/621*** | (2006.01) |
| *H01R 12/71* | (2011.01) |

(52) U.S. Cl.

CPC ..... *H01R 12/7047* (2013.01); *H01R 13/46* (2013.01); *H01R 13/6215* (2013.01); *H01R 12/714* (2013.01)

(58) Field of Classification Search

CPC ..... H01R 13/6215; H01R 13/6395; H01R 13/638; H01R 13/516; H01R 13/621

USPC ..... 439/362, 364, 359

See application file for complete search history.

(56) References Cited

U.S. PATENT DOCUMENTS

| | | | | |
|---|---|---|---|---|
| 4,577,919 | A * | 3/1986 | Waters | 439/597 |
| 5,391,091 | A * | 2/1995 | Nations | 439/378 |
| 5,401,183 | A * | 3/1995 | Tan et al. | 439/347 |
| 7,544,092 | B2 * | 6/2009 | Wu | H01R 13/6215 439/362 |
| 8,231,399 | B2 * | 7/2012 | Daubigney | 439/316 |
| 8,992,249 | B2 * | 3/2015 | Kobayashi et al. | 439/548 |
| 2007/0149039 | A1 | 6/2007 | Wu | |

FOREIGN PATENT DOCUMENTS

DE 44 13 001 A1 10/1994

OTHER PUBLICATIONS

International Search Report, International Application No. PCT/US2015/031874, International Filng Date, May 21, 2015.

* cited by examiner

*Primary Examiner* — Phuong Dinh

(57) ABSTRACT

A connector system includes an interface connector having a housing having a main body holding a contact array therein. The housing extends between a front end and a back end along a mating axis. The housing includes a cavity therein open to the front end and open to the back end. The cavity is situated proximate to a side of the housing. The cavity has a receiving channel open to the side of the housing. The receiving channel has mounting shoulders at least partially extending therein. The interface connector also includes a fastener having a retention surface. The fastener is configured to be side-loaded into the receiving channel through the side of the housing. The mounting shoulders engage the fastener within the cavity to limit transaxial movement of the fastener along the mating axis.

19 Claims, 3 Drawing Sheets

INTERFACE CONNECTOR

BACKGROUND OF THE INVENTION

The subject matter herein relates generally to interface connectors having retention hardware.

Various systems include a receptacle connector to connect a printed circuit board, such as a motherboard, to other electrical components. Electrical components generally include an interface connector that is configured to be coupled to the receptacle connector. The systems may be used in an environment that is subject to vibration and/or movement that may cause the interface connector to become unseated, or uncoupled from the receptacle connector. One or more pieces of retention hardware are typically used to secure the interface connector to the receptacle connector.

Installing the retention hardware on the interface connector typically requires several components, and may involve several stages of assembly. For example, the retention hardware may include a custom made screw that holds the interface connector against the receptacle connector. A locking ring is later attached to a groove on the screw to hold the screw in place. Such an arrangement may include specially made parts, adding cost and additional manufacturing time. Additionally, the assembly process may require manual assembly using specialized tooling.

A need remains for a cost effective and reliable interface connector system having simplified retention hardware.

BRIEF DESCRIPTION OF THE INVENTION

In one embodiment, a connector system having an interface connector is provided that includes a housing having a main body holding a contact array therein. The housing extends between a front end and a back end along a mating axis. The housing includes a cavity therein open to the front end and open to the back end. The cavity is situated proximate to a side of the housing. The cavity has a receiving channel open to the side of the housing. The cavity has mounting shoulders at least partially extending therein. The interface connector also includes a fastener having a retention surface. The fastener is configured to be side-loaded into the receiving channel through the side of the housing. The mounting shoulders engage the fastener to secure the fastener within the cavity to limit transaxial movement of the fastener along the mating axis.

In one aspect, the mounting shoulders include upper mounting shoulders extending into the receiving channel. The upper mounting shoulders engage a lower surface of the fastener to limit movement of the fastener axially along the mating axis.

In another aspect, the mounting shoulders include lower mounting shoulders axially offset relative to the upper mounting shoulders such that the upper and lower mounting shoulders are staggered along the mating axis and receive a portion of the fastener therebetween.

In another aspect, the fastener includes a head having a drive portion. The lower mounting shoulders extend radially inward in the receiving channel such that the lower mounting shoulders provide alignment of a mating tool and the drive portion of the head.

In another aspect, the mounting shoulders are compliant such that the fastener can be removably secured in the cavity.

In another aspect, the side of the housing defines a first side. The housing has a second side diametrically opposed to the first side. The housing has a second cavity that defines a second channel and a second fastener side-loaded into the second cavity.

In another aspect, the fastener is configured to be side-loaded in the receiving channel in a direction generally perpendicular to the mating axis.

In another aspect, the fastener is axially secured within the cavity while being free to rotate within the receiving channel.

In another aspect, the upper mounting shoulders and the lower mounting shoulders are radially offset relative to one another.

In another aspect, the mounting shoulders are separated from one another defining a shoulder gap therebetween. The shoulder gap has a gap width that is less than a shaft diameter of the fastener.

In another aspect, the mounting shoulders include tip extending radially inward into the cavity. The tips being compliant to allow the fastener to pass into the cavity.

In another aspect, the fastener includes a retention surface and a head having a lower surface. The housing has a front surface along the front end. The lower surface of the head abuts against the front surface of the front end. The retention surface extends through the cavity.

In another aspect, the fastener includes a shaft extending between a flange and a head. The shaft is received in the cavity. The head abuts against a front surface of the front end of the housing. The flange is received in a flange receiving portion in the cavity.

In another aspect, the interface connector includes a receptacle connector. The interface connector configured to be mated to the receptacle connector. The receptacle connector has a retention surface configured to receive a complementary retention surface of the fastener to secure the interface connector to the receptacle connector.

In another aspect, the receptacle connector includes a housing having a shape complementary to the housing of the interface connector.

In another embodiment, an interface connector is provided that includes a main body holding a contact array therein. The housing extends between a front end and a back end along a mating axis. The housing includes a cavity therein that is open to the front end and open to the back end. The cavity is situated proximate to a side of the housing. The cavity has a receiving channel open to the side of the housing. The receiving channel has mounting shoulders at least partially extending therein. The interface connector also includes a fastener having a head at a proximal end and a retention surface at a distal end. A main body extends between the head and the retaining surface. The main body has a retaining shaft and a flange. The fastener is configured to be side-loaded into the cavity through the side of the housing. The mounting shoulders engage the retaining shaft of the fastener to secure the fastener within the cavity to limit transaxial movement of the fastener along the mating axis.

In one aspect, the interface connector includes a flange receiving portion configured to receive the flange when the fastener is loaded into the cavity.

In another aspect, receiving channel is generally cylindrical in shape.

In another aspect, the mounting shoulders extend into the cavity towards one another to define a gap width therebetween. The gap width is less than a shaft diameter of the retaining shaft.

In another aspect, the mounting shoulders abut against the head and the flange limit axial movement of the fastener relative to the housing.

DETAILED DESCRIPTION OF THE INVENTION

Figure 1:
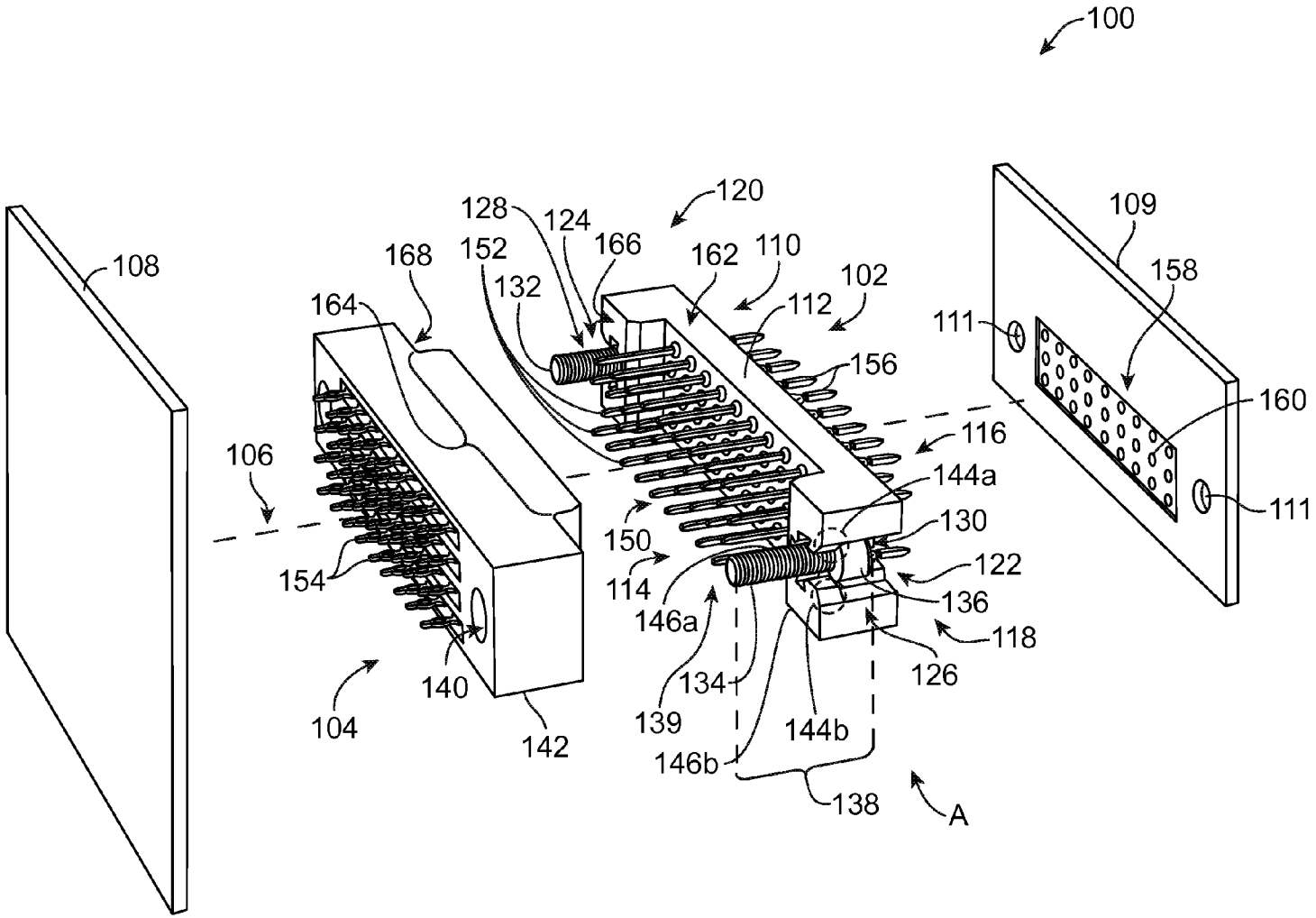
FIG. 1 is an exploded, front perspective view of an interface connector system formed in accordance with an exemplary embodiment.

FIG. 1 is an exploded, front perspective view of a connector system 100 formed in accordance with an exemplary embodiment. The connector system 100 includes an interface connector 102 configured to be coupled to a receptacle connector 104 along a mating axis 106 to form an electrical and mechanical connection therewith. The receptacle connector 104 is configured to be mounted to a circuit board 108, which may be a rigid circuit board or a flexible circuit board. In certain embodiments, the interface connector 102 is mounted to a circuit board 109 and the interface connector 102 and the receptacle connector 104 electrically couple the circuit board 109 to the circuit board 108.

The interface connector 102 includes a housing 110 having a main body 112. The housing 110 extends between a front end 114 and a back end 116 along the mating axis 106. The front end 114 faces the receptacle connector 104 when the interface connector 102 is poised for mating with the receptacle connector 104. The housing 110 includes a first side 118 and a second side 120 diametrically opposed to the first side 118. The first and second sides 118, 120 are generally orthogonal to the front and back ends 114, 116.

The housing 110 includes a first cavity 122 situated proximate to the first side 118, and a second cavity 124 situated proximate to the second side 120. The first cavity 122 opens to the front end 114 and the back end 116. The first cavity 122 has a receiving channel 126 therein. The receiving channel 126 opens to the first side 118. The second cavity 124 also opens to the front end 114 and the back end 116. The second cavity has a receiving channel 128 therein. The receiving channel 128 opens to the second side 120.

The interface connector 102 includes fasteners 130 and 132 configured to secure and hold the interface connector 102 to the receptacle connector 104 in the mated position. The fasteners 130, 132 may be jackscrews used to pull the interface connector 102 into the receptacle connector 104 as the fasteners 130, 132 are tightened. In the illustrated embodiment, the cavity 122 is configured to hold the fastener 130, and the cavity 122 is configured to hold the fastener 132. The fastener 130 is received in the cavity 122 though the receiving channel 126. The fastener 132 is received in the cavity 124 through the receiving channel 128. In certain embodiments, the fasteners 130 and 132 may be identical to one another and the description below, which is in reference to the fastener 130, may apply equally to the fastener 132. The fastener 130 has at least one retention surface 134. For example, the retention surface 134 may be threads along a body or shaft 138 of the fastener 130. The shaft 138 extends from a head 136 of the fastener 130. The body 138 and/or the head 136 may be generally cylindrical in shape and extend along a body axis 139 of the fastener 130.

The receptacle connector 104 includes a complementary threaded receiver 140 (for example, a nut) held by a receptacle housing 142. The retention surface 134 of the fastener 130 may be driven into the threaded receiver 140 to secure the interface connector 102 to the receptacle connector 104. In an exemplary embodiment, the circuit board 109 includes openings 111 to allow a head 176 (shown in FIG. 2) of a drive tool 178 (shown in FIG. 2) to extend therethrough to drive the retention surface 134 into the threaded receiver 140.

The receiving channels 126, 128 have mounting shoulders 144*a*, 144*b*, 144*c*, (shown in FIGS. 3) and 144*d* (shown in FIG. 3) at least partially extending therein. As illustrated, the mounting shoulders 144*a*, 144*b* extend radially inward from opposite sides of the receiving channel 126. The receiving channel 128 may include similar mounting shoulders 144. The mounting shoulders 144 engage the body 138 to secure or hold the fastener 130 within the cavity 122. The mounting shoulders 144*a* and 144*b* include tips 146. The tips 146 may be selectively shaped to align the fastener 130 with the receiving channel 126. For example, the tips 146 may be rounded or inclined to guide the body 138 of the fastener 130 into the receiving channel 126. The tips 146 may align the body axis 139 with the receiving channel 126 such that the body axis 139 is approximately parallel with the mating axis 106.

The fasteners 130, 132 are configured to be side-loaded into the respective receiving channels 126, 128. For example, the fastener 130 may be side-loaded into the cavity 122 through the receiving channel 126 in a direction indicated by the arrow A that is generally perpendicular to the mating axis 106. The mounting shoulders 144 may be compliant such that the fastener 130 may be allowed to pass into the cavity 122 without permanently deforming the mounting shoulders 144 (for example, sufficient yield to avoid inelastic deformation). For example, the tips 146 may be partially compressed inward as the fastener 130 is pressed through the receiving channel 126 into the cavity 122.

When the fastener 130 is inserted into the cavity 122, the fastener 130 is axially secured in the cavity 122 by the mounting shoulders 144. A lower surface 148 (shown in FIG. 2) of the mounting shoulders 144 abuts a contact surface 149 (shown in FIG. 2) of the head 136 of the fastener 130. As such, the fastener 130 may be free to rotate along the body axis 139 while substantially reducing transaxial movement of the fastener 130 within the cavity 122.

The housing 110 holds a contact array 150. The contact array 150 includes a plurality of contact pins 152 arranged in rows and columns at the first end 114. The contact pins 152 are configured to be electrically coupled to signal contacts 154 in the receptacle connector 104.

The interface connector 102 includes interface pins 156 at the back end 116 of the interface connector 102. The contact pins 152 are electrically connected to corresponding interface pins 156. The interface pins 156 are configured to be terminated to the circuit board 109. For example, the interface pins 156 may be received in vias 158 of the circuit board 109. The interface pins 156 may be compliant pins, such as eye-of-the-needle pins. Alternatively, the interface pins 156 may be solder balls.

The housing 142 of the receptacle connector 104 may have a complementary shape for mating with the housing 110 of the interface connector 104. The housings 110, 142 may be shaped to encourage alignment of the interface connector 102 with the receptacle connector 104. The housings 110, 142 may be complementary to one another to reduce movement of the interface connector 102 relative to the receptacle connector 104 transverse to the mating axis 106. For example, in the illustrated embodiment, the housing 110 has a pocket at a center region 162 open to the front end 114 that receives a complementary raised portion 164 of the housing 142. When the interface connector 102 is mated with the receptacle connector 104, the center region 162 receives the raised portion 164. The center region 162 holds the raised portion 164 therein.

In operation, during mating of the interface connector 102 with the receptacle connector 104, the fastener 130 is inserted to and through the receiving channel 126. The fastener 132 is inserted to and through the receiving channel 128. The body 112 of the housing 110 is then aligned with the housing 142 of the receptacle connector 104 along the mating axis 106. When aligned, the fasteners 130, 132 align with the threaded receivers 140 in the receptacle housing 142. The fasteners 130, 132 are then driven or screwed into the threaded receiver 140. Because the contact surface 149 of the head 136 abuts the lower surface 148 of the mounting shoulders 144, the interface connector 102 is caused to translate in a direction parallel to the mating axis 106 when the fasteners 130, 132 are driven. The fasteners 130, 132 are driven until a front surface 166 of the front end 114 abuts a top surface 168 of the receptacle housing 142. When the interface connector 102 is mated with the receptacle connector 104, the contact pins 152 make electrical and mechanical contact with the receptacle signal contacts 154.

Figure 2:
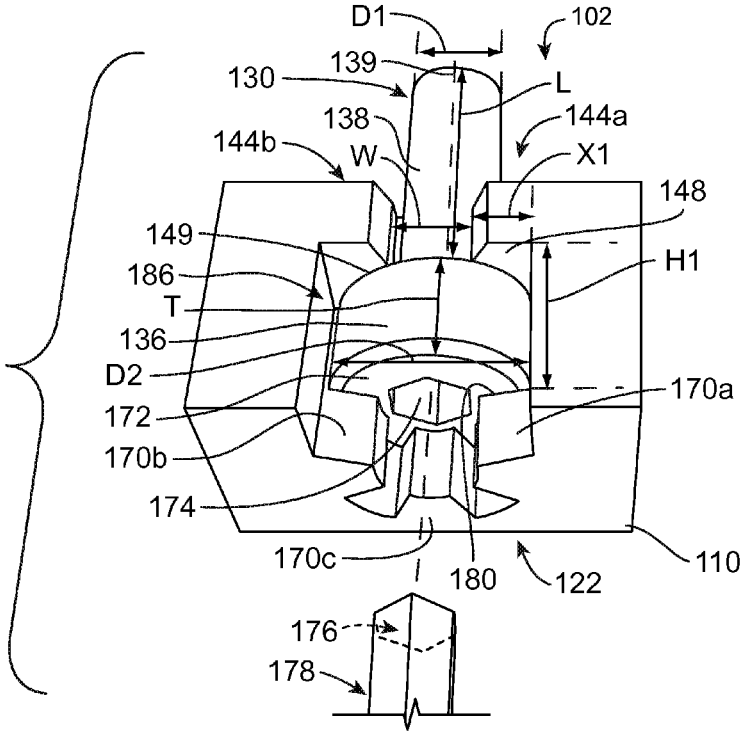
FIG. 2 is a bottom perspective view of a fastener positioned in a cavity of interface connector formed in accordance with an embodiment.

FIG. 2 is a bottom perspective view of the fastener 130 positioned in the cavity 122 of the interface connector 102. In the illustrated embodiment, the interface connector 102 (also shown in FIG. 1) includes lower mounting shoulders 170*a*, 170*b*, and 170*c*, which extend radially inward into the cavity 122. In such embodiments, the mounting shoulders 144 define upper mounting shoulders 144. Although only the first cavity 122 is illustrated, the second cavity 124 (shown in FIG. 1) may include upper and lower mounting shoulders 144, 170 in a similar arrangement.

The head 136 of the fastener 130 includes the contact surface 149 and an interface surface 172. The contact surface 149 and the interface surface 172 are separated by a distance that defines a thickness T of the head 136. The contact surface 149 faces the lower surface 148 of the upper mounting shoulders 144. The interface surface 172 includes a drive portion 174 configured to receive the complementary head 176 of the drive tool 178. For example, in the illustrated embodiment, the drive portion 174 is a hexagonal depression on the interface surface 172 and is centered on the body axis 139 of the fastener 130. The body 138 extends from the contact surface 149 of the head 136 a length L. The body 138 has a shaft or body diameter D1 that is less than a head diameter D2 the head 136.

The upper mounting shoulders 144 and the lower mounting shoulders 170 are separated by a distance that defines a height H1 of a head receiving portion 186 of the cavity 122. The head receiving portion 186 is sized and shaped to receive the head 136. The height H1 is based on the thickness T of the head 136. The height H1 may be approximately the same as the thickness T such that the upper and lower mounting shoulders 144, 170 limit movement of the fastener 130 along the body axis 139 and the mating axis 106 (shown in FIG. 1). The head 136 may be bound between an upper surface 180 of the lower mounting shoulders 170 and the lower surface 148 of the upper mounting shoulders 144. The upper surface 180 abuts the interface surface 172 of the head 136. The lower surface 148 abuts the contact surface 149 of the head 136. As such, the fastener 130 may be held within the cavity 122 to limit or eliminate independent movement of the fastener 130 relative to the housing 110 along the mating axis 106 (shown in FIG. 1).

The upper shoulders 144 may be sized and shaped based on the diameter D1 of the body 138 to retain the fastener 130. The shoulders 144*a* and 144*b* may be mirror images of one another. Each of the upper shoulders 144 extend a distance X1 into receiving channel 126. The distance X1 may be based on the body diameter D1 of the fastener 130. The shoulders 144 may extend radially inward toward one another such that shoulders 144 define a shoulder gap having a gap width W therebetween. The gap width W may be less than the diameter D1 of the body 138 to ensure that the shoulders 144 retain the fastener 130 within the cavity 122.

The lower shoulders 170 extend radially inward into the cavity 122. The lower shoulders 170 are configured to align the drive tool 178 when the drive tool 178 is inserted into the cavity 122 to engage the drive portion 174. The lower shoulders 170 also restrain the fastener 130 within the cavity 122. The upper surface 180 abuts the interface surface 172 of the head 136 when the fastener 130 is inserted into the cavity 122.

Figure 3:
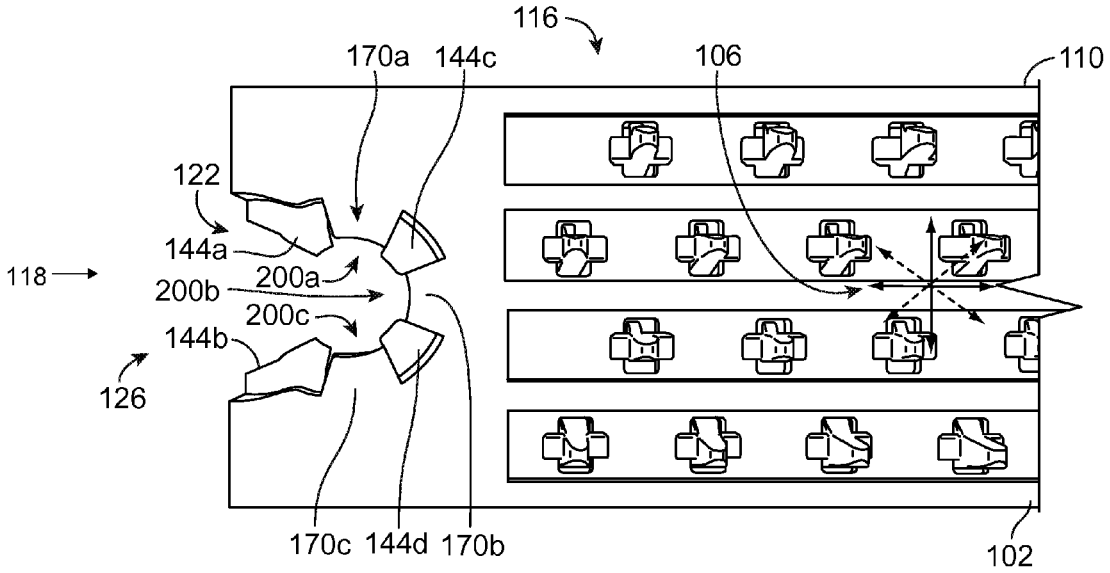
FIG. 3 is a bottom perspective of the back of an interface connector formed in accordance with an embodiment.

FIG. 3 bottom perspective view of the back end 116 of the interface connector 102. In the illustrated embodiment, the upper mounting shoulders and the lower mounting shoulders 144, 170 are offset relative to each other. For example, the upper mounting shoulders 144 are relatively offset, or staggered, relative to the lower mounting shoulders 170 along the mating axis 106.

The upper mounting shoulders 144 and the lower mounting shoulders 170 may be radially offset relative to one another. The upper and lower mounting shoulders 144, 170, respectively, are radially dispersed around the perimeter of the cavity 122. The upper mounting shoulders 144 include gaps 200 between individual tines of the mounting shoulders 144. For example, the mounting shoulders 144*a* and 144*c* have a gap 200*a* therebetween. The mounting shoulders 144*c* and 144*d* have a gap 200*b* therebetween. The mounting shoulders 144*d* and 144*b* have a gap 200*c* therebetween. The lower mounting shoulders 170 are aligned with the gaps 200 to offset the upper mounting shoulders 144 relative to the lower mounting shoulders 170. The individual tines 144*a*, 144*b*, 144*c*, and 144*d* are arranged such that the upper mounting shoulders 144 are radially spaced apart from the tines 170*a*, 170*b*, and 170*c* of the lower mounting shoulders 170. The lower mounting shoulders 170 may be aligned with the gaps 200 along the mating axis 106. For example, the lower mounting shoulder 170*a* is aligned with the gap 200*a*. The lower mounting shoulder 170*c* is aligned with the gap 200*b*. The lower mounting shoulder 170*b* is aligned with the gap 200*c*. In this manner, the mounting shoulders 144, 170 radially support the fastener 130 (shown in FIGS. 1 and 2) along the mating axis 106. In other embodiments, for example, as shown FIG. 4, the upper and lower mounting shoulders 144, 170 may have continuous surfaces that do not include the gaps 200.

The housing 110 may be manufactured from a plastics material. For example, the mounting shoulders 144, 170 may be molded using a die cast molding process. The gaps 200 may be used during the molding process to allow filler material to be introduced between the upper mounting shoulders and the lower mounting shoulders 144, 170 to define the receiving channel 126 and the cavity 122. As such, the housing 110 may be molded using bypass tooling that does not require the use of side action tooling (for example, filler material introduced from the side 118 in a molding process). Accordingly, by utilizing bypass tooling, tooling complexity may be reduced, and cost savings may be realized.

Figure 4:
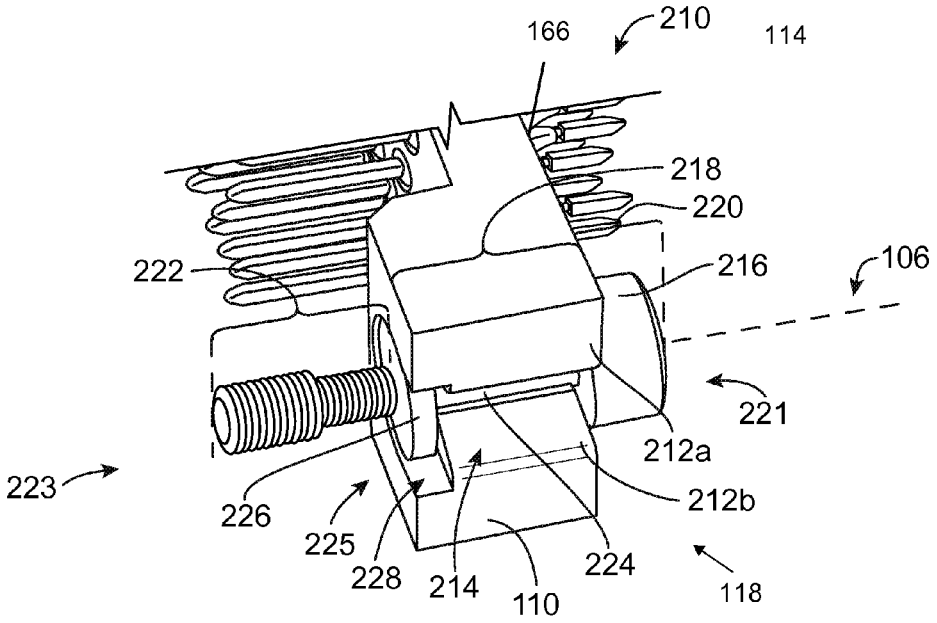
FIG. 4 is a side perspective view of an interface connector having mounting shoulders formed in accordance with an embodiment.

FIG. 4 is a side perspective view of an interface connector 210 having mounting shoulders 212 formed in accordance with an exemplary embodiment. The mounting shoulders 212 are configured to hold a flanged fastener 216 in a cavity 225. The cavity 225 is situated proximate to the side 118. The mounting shoulders 212*a* and 212*b* are unsegmented such that the mounting shoulders 212 do not include the gaps 200 (shown in FIG. 3) between the individual mounting shoulders 212. Additionally, the mounting shoulders 212 do not include discrete upper and lower mounting shoulders 144, 170 (both shown in FIG. 2). Instead, the mounting shoulders 212 extend along a length of the housing 110.

Figure 5:
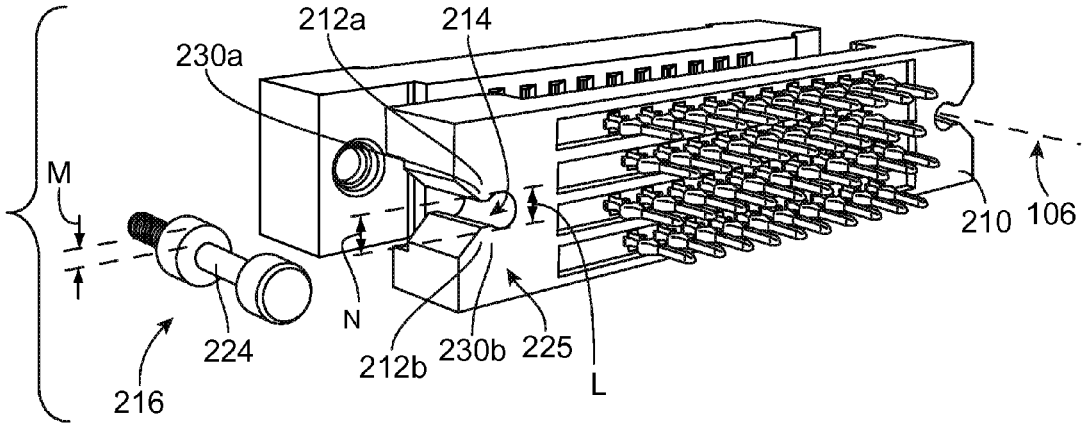
FIG. 5 is a bottom perspective view of an interface connector formed in accordance with an embodiment.

The mounting shoulders 212 extend from the housing 110 into the cavity 225 to define a receiving channel 214 therein (also shown in FIG. 5). The mounting shoulders 212 are configured to hold the flanged fastener 216 within the cavity 225. Specifically, the mounting shoulders 212 hold the flanged fastener 216 in the cavity 225 such that trans-axial movement relative to the mating axis 106 is essentially eliminated. The flanged fastener 216 is configured to be side-loaded into the cavity 225 via the receiving channel 214.

The flanged fastener 216 includes a main body 218 extending between a head 220 and a retention surface 222. The head 220 is positioned at a proximal end 221 of the fastener 216. The retention surface 222 is positioned at a diametrically opposed distal end 223 of the fastener 216. In the illustrated embodiment, the retention surface 222 includes threads configured to be mated to the threaded receiver 140 (shown in FIG. 1) of the receptacle connector 104 (also shown in FIG. 1). The main body 218 includes a retaining shaft 224 and a flange 226 positioned between the retention surface 222 and the head 220. The retaining shaft 224 extends between the flange 226 and the head 220. The flanged fastener 216 is configured to secure the interface connector 210 to the housing 142 of the receptacle connector 104 (both shown in FIG. 1).

The housing 110 includes a flange receiving portion 228 configured to receive the flange 226 therein. In the illustrated embodiment, the flange receiving portion 228 is a cavity or slot dimensioned to receive the flange 226. When the flanged fastener 216 is side-loaded into the cavity 122, the flange receiving portion 228 receives the flange 226. The head 200 abuts against the front surface 166 along the front end 114 of the housing 110. The flange 226 and the head 220 secure the flanged fastener 216 in the cavity 122 to reduce or eliminate movement of the flanged fastener 216 relative to the housing 110 along the mating axis 106.

FIG. 5 is a bottom perspective view of the interface connector 210. The flanged fastener 216 (also shown in FIG. 4) is poised for loading into the cavity 225. In the illustrated embodiment, the cavity 225 is generally cylindrical in shape extending along the mating axis 106. The cavity 225 has a central diameter L that is greater than a shaft diameter M of the retaining shaft 224 such that the retaining shaft 224 is free to spin within the cavity 225.

The mounting shoulders 212 extend into the cavity 122 toward one another. The mounting shoulders 212*a*, 212*b* include tips 230*a*, 230*b*, respectively, at ends of the mounting shoulders 212. The tips 230*a* define a gap distance or width N therebetween. The gap width N is less than the shaft diameter M. As such, the gap width N is also less than the central diameter L. As such, the mounting shoulders 212 engage the retaining shaft 224 when the flanged fastener 216 is inserted into the cavity 122. The tips 230 may be compliant to allow the flanged fastener 216 to removably pass into the cavity 225. In the illustrated embodiment, the tips 230 are chamfered to guide the retaining shaft 224 into the receiving channel 214. In other embodiments, other configurations are possible, such as, for example, rounded tips.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A connector system comprising:

an interface connector having:

a housing having a main body holding a contact array therein, the housing extending between a front end and a back end along a mating axis, the housing including a cavity therein open to the front end and open to the back end, the cavity situated proximate to a side of the housing, the cavity having a receiving channel open to the side of the housing, the receiving channel having at least one upper mounting shoulder and at least one lower mounting shoulder, the upper and lower mounting shoulders at least partially extending into receiving channel, the lower mounting shoulder being axially offset relative to the upper mounting shoulder such that the upper and lower mounting shoulders are staggered along the mating axis and receive a portion of the fastener therebetween; and a fastener having a retention surface, the fastener configured to be side-loaded into the receiving channel through the side of the housing, the upper and lower mounting shoulders being configured to engage the fastener to secure the fastener within the cavity to limit transaxial movement of the fastener along the mating axis.

2. The connector system of claim 1, wherein the at least one upper mounting shoulder further comprise a plurality of upper mounting shoulders positioned radially about the receiving channel.

3. The connector system of claim 1, wherein the at least one upper mounting shoulder further comprise a plurality of upper mounting shoulders radially spaced apart by upper gaps and at least one lower mounting shoulder further comprise a plurality of lower mounting shoulders radially spaced apart by lower gaps, the lower mounting shoulders being radially offset relative to the upper mounting shoulders such that the upper mounting shoulders are aligned with the lower gaps along the mating axis and such that the lower mounting shoulders are aligned with the upper gaps along the mating axis.

4. The connector system of claim 1, wherein the fastener includes a head having a drive portion, the lower mounting shoulders extending radially inward in the receiving channel such that the lower mounting shoulders provide alignment of a mating tool to the drive portion of the head.

5. The connector system of claim 1, wherein the mounting shoulders are compliant such that the fastener can be removably secured in the cavity.

6. The connector system of claim 1, wherein the side of the housing defines a first side, the housing having a second side diametrically opposed to the first side, the housing having a second cavity defining a second receiving channel and a second fastener side-loaded into the second receiving channel.

7. The connector system of claim 1, wherein the fastener is configured to be side-loaded in the receiving channel in a direction generally perpendicular to the mating axis.

8. The connector system of claim 1, wherein the fastener is axially secured within the cavity such that the fastener is free to rotate within the cavity.

9. The connector system of claim 1, wherein the mounting shoulders are separated from one another defining a shoulder gap therebetween, the shoulder gap having a gap width, the gap width being less than a shaft diameter of the fastener.

10. The connector system of claim 1, wherein the mounting shoulders include tips extending radially inward into the cavity, the tips being compliant to allow the fastener to pass into the cavity.

11. The connector system of claim 1, wherein the fastener includes a retention surface and a head having a lower surface, the housing having a front surface along the front end, the lower surface of the head abutting against the front surface of the front end, the retention surface extending through the cavity.

12. The connector system of claim 1, wherein the fastener includes a shaft extending between a flange and a head, the shaft received in the cavity, the head abutting against a front surface along the front end of the housing, the flange received within a flange receiving portion in the cavity.

13. The connector system of claim 1, further comprising a receptacle connector, the interface connector configured to be mated to the receptacle connector, the receptacle connector having a threaded receiver configured to receive a complementary retention surface of the fastener to secure the interface connector to the receptacle connector.

14. The connector system of claim 13, wherein the receptacle connector further comprises a housing having a shape complementary to the housing of the interface connector.

15. An interface connector comprising:

a housing having a main body holding a contact array therein, the housing extending between a front end and a back end along a mating axis, the housing including a cavity therein open to the front end and open to the back end, the cavity situated proximate to a side of the housing, the cavity having a receiving channel open to the side of the housing, the receiving channel having axially disposed upper and lower mounting shoulders at least partially extending therein; and a fastener having head at a proximal end and a retention surface at a distal end, and a main body therebetween, the main body having a retaining shaft, the fastener configured to be side-loaded into the cavity through the side of the housing such that the head is positioned between the axially disposed upper and lower mounting shoulders, the upper and lower mounting shoulders engaging the head of the fastener to secure the fastener within the cavity to limit transaxial movement of the fastener along the mating axis.

16. The interface connector of claim 15, wherein the housing includes a flange receiving portion configured to receive a flange of the fastener when the fastener is loaded into the cavity.

17. The interface connector of claim 15, wherein the cavity is generally cylindrical in shape.

18. The interface connector of claim 15, wherein the upper and lower mounting shoulders includes a plurality of upper mounting shoulders radially spaced apart by upper gaps and a plurality of lower mounting shoulders radially spaced apart by lower gaps, the lower mounting shoulders being radially offset relative to the upper mounting shoulders such that the upper mounting shoulders are aligned with the lower gaps along the mating axis and such that the lower mounting shoulders are aligned with the upper gaps along the mating axis.

19. The interface connector of claim 15, wherein the head includes a drive portion, the lower mounting shoulders extending radially inward in the receiving channel such that the lower mounting shoulders provide alignment of a mating tool to the drive portion of the head.

* * * * *